US007842625B1

(12) United States Patent
Stockton et al.

(10) Patent No.: US 7,842,625 B1
(45) Date of Patent: Nov. 30, 2010

(54) METHODS FOR TREATING FABRIC TO FACILITATE MOISTURE TRANSFER FROM ONE SIDE TO THE OTHER

(75) Inventors: William B. Stockton, San Francisco, CA (US); William Ware, Jr., Redwood City, CA (US)

(73) Assignee: Nano-Tex, Inc., Oakland, CA (US)

( * ) Notice: Subject to any disclaimer, the term of this patent is extended or adjusted under 35 U.S.C. 154(b) by 233 days.

(21) Appl. No.: 11/977,234

(22) Filed: Oct. 24, 2007

Related U.S. Application Data

(60) Provisional application No. 60/855,096, filed on Oct. 26, 2006.

(51) Int. Cl.
*B32B 5/18* (2006.01)
*D06M 15/00* (2006.01)

(52) U.S. Cl. ..... 442/82; 442/76; 442/88; 442/164; 442/63; 8/115.6; 8/115.54

(58) Field of Classification Search ..... None
See application file for complete search history.

(56) References Cited

U.S. PATENT DOCUMENTS

| | | | |
|---|---|---|---|
| 3,250,095 | A | 5/1966 | Bird |
| 6,381,994 | B1 | 5/2002 | Lee |
| 6,432,504 | B1 | 8/2002 | Yeh |
| 6,544,594 | B2 | 4/2003 | Linford et al. |
| 6,806,214 | B2 | 10/2004 | Li et al. |
| 6,855,772 | B2 | 2/2005 | Linford et al. |
| 7,008,887 | B2 | 3/2006 | Rearick et al. |
| 7,056,845 | B2 | 6/2006 | Waeber et al. |
| 2003/0181118 | A1 | 9/2003 | Ko et al. |
| 2003/0182922 | A1 | 10/2003 | Peters et al. |
| 2003/0196275 | A1 | 10/2003 | Rayborn et al. |
| 2004/0006827 | A1 | 1/2004 | Rising |
| 2004/0037963 | A1 | 2/2004 | Hubner et al. |
| 2004/0116015 | A1 * | 6/2004 | Hayes et al. ..... 442/94 |
| 2004/0134421 | A1 | 7/2004 | Rising |
| 2006/0035798 | A1 | 2/2006 | Rising |
| 2006/0135386 | A1 | 6/2006 | Rising |
| 2006/0148356 | A1 | 7/2006 | Zhang et al. |
| 2006/0217279 | A1 | 9/2006 | Rising |
| 2007/0151039 | A1 | 7/2007 | Hubner et al. |

FOREIGN PATENT DOCUMENTS

| | | | |
|---|---|---|---|
| AU | 2003249700 | A1 | 1/2004 |
| WO | 2004004924 | A2 | 1/2004 |
| WO | WO 2006/042375 | A1 | 4/2006 |

* cited by examiner

*Primary Examiner*—D. Lawrence Tarazano
*Assistant Examiner*—Ricardo E Lopez
(74) *Attorney, Agent, or Firm*—Smith Moore Leatherwood LLP

(57) ABSTRACT

The present invention relates to methods and compositions for treating fabrics to facilitate moisture transfer from one side of the fabric to the other, and fabrics made according to such methods. The fabrics generally have one side or surface of the fabric treated with a net hydrophobic composition, whereas the opposing surface of the fabric is not treated with the net hydrophobic composition.

18 Claims, No Drawings

METHODS FOR TREATING FABRIC TO FACILITATE MOISTURE TRANSFER FROM ONE SIDE TO THE OTHER

CROSS-REFERENCE TO RELATED APPLICATIONS

This application claims the benefit of U.S. provisional patent application Ser. No. 60/855,096, filed on Oct. 26, 2006, the entire disclosure of which is incorporated herein by reference.

STATEMENT OF RIGHTS TO INVENTIONS MADE UNDER FEDERALLY SPONSORED RESEARCH

The U.S. government has a paid-up license in this invention and the right in limited circumstances to require the patent owner to license others on reasonable terms as provided for by the terms of Contract number W911QY-06-C-0087 awarded by Natick Soldier Center.

TECHNICAL FIELD

The present invention relates to methods for treating fabrics to facilitate moisture transfer from one side of a fabric to the other, and to fabrics made according to such methods.

BACKGROUND OF THE INVENTION

Active wear apparel and apparel designed to be worn in hot, humid environments are generally characterized as being well suited to be worn during times when one is likely to be perspiring. Optimally, the active wear garment should have some moisture management capability, while still remaining comfortable, providing freedom of movement and being easy to care for. One of the prime factors for garment comfort when perspiring heavily is how well the garment transfers moisture away from the skin. Additionally, for greater comfort after periods of heavy perspiration, the garment should optimally feel dry next to the skin or inner garments.

Garments made from cotton fabric and other natural material fabrics (such as linen, wool, etc.) are generally absorbent, and continue to feel comfortable under conditions of very light perspiration. This is because the fabric absorbs the relatively small amount of moisture produced at these times, keeping the wearer feeling dry. However, under conditions of heavier perspiration, these fabrics feel wet, heavy and clingy, restricting movement and becoming uncomfortable to wear. Additionally, once these fabrics become wet, they take a long time to dry, and continue to feel damp and uncomfortable until they have fully dried. This dampness can have other undesirable effects on the wearer as well. For example, wet fabrics are known to have increased friction against skin. This dramatically increases the chafing and even blistering resulting from movement, commonly suffered during athletic activity. Also, a damp fabric tends to chill the wearer, once physical activity is stopped, through excessive evaporative cooling. This is most prominent when the dampness is in direct contact with the skin. Comfort is particularly compromised with wool garments, which become much more irritating to the skin when damp.

Fabrics made from untreated polyester, nylon and other synthetic materials do not readily absorb moisture, due to being hydrophobic. As a result, when untreated synthetic fabrics are worn under conditions of even moderate perspiration, moisture tends to build up on the skin, because the fabric does not absorb moisture. Thus, when wearing untreated garments made of synthetic fibers, water tends to bead up and become trapped on the inner surface of the garment, resulting in an extremely uncomfortable garment.

A variety of methods have been used to improve the moisture transfer characteristics of untreated fabrics; three are outlined here. One common method is to apply a hydrophilic finish to a hydrophobic fabric made from synthetic fibers, rendering it a wicking fabric. A second method of improving moisture transfer is to use various fabric construction techniques to create fabrics that are more hydrophobic on one surface and more hydrophilic on the other surface, leading to moisture transfer from the hydrophobic side to the hydrophilic side. A third method has been developed for cotton by treating one side of the fabric with a discontinuous hydrophobic coating, leaving untreated areas as "wicking channels" in the fabric. These three methods are described below:

In the first method, as mentioned above, a hydrophilic finish is applied durably to a synthetic fiber fabric. For example, see U.S. Pat. Nos. 6,855,772 and 6,544,594. These fabrics quickly transfer and spread moisture, increasing the surface area of the moisture to enhance evaporation. Since the underlying fibers are hydrophobic, the fibers themselves do not absorb moisture, unlike cotton or wool fibers. Because these fabrics do not absorb moisture into the fibers themselves, the moisture resides primarily in the capillaries between fibers and yarns. This enhances lateral wicking, which may lead to a greater surface area of the moisture and thus faster drying. However, the moisture still resides throughout the thickness of the fabric. This means that the inner surface (touching the skin) can remain wet and clingy. In addition, when compared to natural fiber fabrics, synthetic fiber fabrics are generally known to have other undesirable properties, such as pilling, static cling, odor retention, and an "unnatural" feel. This type of hydrophilic-treatment is designed primarily for synthetic fabrics.

In the second method, various kinds of fabric construction techniques have also been used to create fabrics that transfer moisture form one side of the fabric to the other. One such fabric construction is described in U.S. Patent Publication No. 2003/0181118, which describes generally a fabric made from two different types of yarn, where one yarn is more hydrophilic and the other is more hydrophobic. These yarns are woven or knitted in such a way that the hydrophobic yarns are predominantly on one side of the fabric and the hydrophilic yarns are primarily on the other side of the fabric. A portion of the hydrophilic yarns penetrates to the hydrophobic side, acting to channel liquid to the hydrophilic side. As a result, water is transferred from the hydrophobic side to the hydrophilic side, although some water remains on both sides, residing in the hydrophilic channels. A similar type of fabric construction is also described in U.S. Pat. No. 3,250,095 and U.S. Pat. No. 6,806,214. See also US 2006/0148356 and WO 2006/042375.

Another method of weaving or knitting more than one kind of yarn together is shown in U.S. Pat. No. 6,381,994. In this case, the two yarns are synthetic fiber yarns where one yarn has undergone a treatment that creates larger void sizes. These yarns are woven or knitted into a fabric in such a way that causes the treated fibers to be primarily on one side of the fabric and the untreated fibers to be primarily on the other side of the fabric. Moisture transport across the fabric is driven by the difference in void sizes between the types of yarns.

Another example of fabric construction techniques consists of a fabric construction wherein the final fabric is made from layers of two different hydrophilic fabrics, as is described in U.S. Pat. No. 6,432,504. One layer (the interior or "skin" side of a garment) is made from coarser fibers, while the second layer is made from finer fibers. Both layers will absorb and wick moisture, but the outer layer made from finer fiber has greater moisture absorbency, due to the smaller fiber size and thus a stronger capillary wicking force. This difference in absorbency drives moisture transfer from the less absorbent (coarser fiber) layer to the more absorbent (finer fiber) layer. This type of construction is commonly referred to as "denier gradient."

A more complex fabric construction is described in U.S. Pat. Publn. 2003/0182922. This patent describes two fabrics that enhance moisture transfer. The fabric construction depends on the use of composite yam that has an inner core of hydrophilic fibers surrounded by an outer sheath of hydrophobic fibers. The first fabric described is made from the composite yarn alone. The second fabric is comprised of two layers of fabric components bound together. The inside fabric component is made from only hydrophobic fibers. The outside fabric component is made from the above-described composite yarn. These two fabric components are joined together to form a fabric such that the fabric component made from only hydrophobic fibers is on the inner face of the fabric and the fabric component made from composite yarn (hydrophilic) is on the outer face of the fabric. Moisture transfer through this two-layered fabric is driven by the difference in hydrophilicity between the inner (hydrophobic) layer and the outer (hydrophilic) layer, but generally requires some extent of wicking channels in the form of hydrophilic yarns or fiber bundles that traverse from outside to the inner side.

All of these fabric construction techniques described above involve somewhat complicated weave or knit constructions combined with specialty yarns, thus limiting their applicability. In addition, such constructions are generally not effective at leaving the inside surface of the fabric (touching the skin) dry. In practice, these fabrics will move a portion of liquid moisture from the inside to the outside, but a significant portion will remain on the inside, thus still feeling wet.

In the third method, a method of treating cellulosic fabrics to form a discontinuous hydrophobic coating is described in U.S. Pat. No. 7,008,887. In this case, the cellulosic fabric (which is naturally hydrophilic) is treated on the inside with a hydrophobic finish (such as a fluoropolymer, silicone, or waxy polymer). The finish is applied in a discontinuous pattern, such that "wicking channels" (i.e. untreated regions of fabric) are formed. Moisture is absorbed into the untreated wicking channel regions and then wicks to the other areas of the garment to enhance evaporation. Other coating methods are also described, such as continuous hydrophobic coatings coupled with the creation of wicking windows or channels, e.g., by using needle punching to push through cellulosic fibers that are capable of wicking liquid from the inside to the outside of the fabric. However, wicking channels will remain wet and in contact with the skin, which is uncomfortable to the wearer. In addition, the method described in this patent is limited to cellulosic substrates.

In all of the aforementioned examples, attempts have been made using mechanical approaches (such as by combining materials or forming wicking channels) to enhance the transfer of moisture from one side of a fabric to another. These (and other) mechanical approaches often use complicated materials and fabric construction techniques, and are thus limited in the types of fabrics for which they are useful. The fabrics of these examples are either difficult or expensive to manufacture, require specialty fibers, and/or do not effectively leave the inner surface of the fabric dry under moderate to heavy perspiration situations.

There thus exists a need for alternative methods and compositions for imparting moisture transfer capability to a fabric and for fabrics treated by such methods and with such compositions.

SUMMARY OF THE INVENTION

The present invention relates to methods and compositions to treat a surface of a fabric such that the fabric is capable of transferring moisture from one side of the fabric to the other, and to fabrics made in accordance with the methods and/or compositions. A fabric made in accordance with the methods described herein is generally capable of transferring or wicking moisture from one side of the fabric to the other. The fabric is capable of moisture transfer due to treatment applied to a single surface of the fabric. That is, the fabrics generally have one side or surface of the fabric treated with a net hydrophobic composition, whereas the opposing surface of the fabric is not treated with the net hydrophobic composition. A fabric that is controllably treated with a net hydrophobic composition on only a single surface of the fabric has a hydrophilicity gradient that extends from the treated surface of the fabric (which is less hydrophilic) to the untreated surface of the fabric (which is more hydrophilic).

The methods of the present invention involve treating a fabric with compositions having a proper balance of hydrophobicity to hydropholicity, wherein the compositions are net hydrophobic in character (i.e., a "net hydrophobic composition"). A net hydrophobic composition is predominantly hydrophobic but has a hydrophilic component as well. The net hydrophobic compositions are predominantly hydrophobic so as to "push" the moisture through the thickness of the fabric. Yet, the moisture transfer ability is also driven by the hydrophilic portion or component of the composition and by the "pull" of the hydrophilic untreated outer side of the fabric. This "push" and "pull" combination also acts to keep the moisture that has been transferred to the untreated side of the fabric from moving back toward and through to the treated or inner surface of the fabric, and thus the treated surface of the fabric remains dry.

The net hydrophobic compositions are generally applied to a single surface of the fabric in a controlled manner and are applied as a continuous surface treatment. This treatment allows moisture to wick through the treated surface of a fabric without fully wetting the treated surface. The wicked moisture is transferred to the untreated side of the fabric, which is generally hydrophilic. The transferred moisture may evaporate from the untreated surface of the fabric and leave the moisture-wicking fabric dry. Garments produced according to these methods are capable of transferring moisture from one side of the fabric to the other and remain comfortable to the wearer, even during times of perspiration.

Advantages of the methods, compositions and fabrics disclosed herein include: (1) the universality of the methods (the treatment can be applied to most any fabric—natural or synthetic fiber based), (2) the relative simplicity of the applications, and primarily (3) the ability to render the entire treated surface of the fabric (such as, e.g., the inner surface of a garment) dry while still quickly wicking moisture away from the treated surface to the untreated surface (such as, e.g., the outer surface of a garment). This is accomplished without macroscale wicking channels, without special weaving or knitting construction, and without specialty or mixed yarns.

DESCRIPTION OF THE INVENTION

The present invention relates to methods and compositions for treating fabrics to facilitate moisture transfer from one side of a fabric to the other, and to fabrics made according to such methods. In one aspect, methods involve the creation of a hydrophilicity gradient in a fabric, where the gradient extends from a treated side of the fabric to an untreated side of the fabric. For instance, a garment whose fabric has a hydrophilicity gradient is capable of transferring moisture, such as perspiration or liquid water, away from the treated or inner surface of the fabric (such as is worn next to the skin) towards the untreated outside of the fabric where water can be more easily evaporated. Thus, in one aspect, the present invention involves the creation of a hydrophobicity gradient from the inside to the outside of a fabric to facilitate the transport of water molecules away from the surface of the fabric worn next to the skin and towards the outside of the fabric where water can be more easily evaporated.

It is also recognized that the outer side (rather than the inside) of a garment may be treated with a net hydrophobic composition such that no moisture wicks to the outside. Such an application would be primarily for aesthetics, such that perspiration would be absorbed, but not show. By containing the moisture on the inner side of the garment, there would be no visible perspiration stains, (however some comfort may be compromised). As outlined above, once moisture reaches the untreated side (in this case, the inside), it remains there and generally will not penetrate through the treated side. Accordingly, the present invention also relates to methods and compositions for treating fabrics to inhibit the transfer of moisture from one side of a fabric to the other, and to fabrics made according to such methods.

In one embodiment, the invention relates to a fabric wherein a single side or surface of the fabric has been treated with a net hydrophobic composition. The net hydrophobic composition may be distributed evenly across a single surface of the fabric (the treated side of the fabric) and penetrate some distance into the fabric in such a manner that it does not reach the untreated, opposing side of the fabric. This controlled application of a net hydrophobic treatment creates a "hydrophilicity gradient" through the thickness of the fabric, where the treated side of the fabric is less hydrophilic, the hydrophilicity increases through the thickness of the fabric, and the untreated surface of the fabric remains more hydrophilic. The net hydrophobic composition treatment creates a surface which absorbs water and rapidly transports the water to the opposing (non-treated) side. Accordingly, the treated side of the fabric remains relatively dry while absorbing and transporting water toward the untreated side.

The net hydrophobic composition may be a net hydrophobic copolymer, a net hydrophobic polymer blend (such as a blend of hydrophilic/hydrophobic polymers or a blend of copolymers or a blend of a mixture of polymers and copolymers in any ratio), or a net hydrophobic blend of reactive non-polymeric molecules. The net hydrophobic compositions are capable of bonding to the fabric surface, such as by physical or chemical bonds.

Methods of applying the net hydrophobic composition to a surface of a fabric and methods of creating a fabric that wicks moisture from one side to the other are also described.

The Fabric

The fabric is generally planar, but can be preconstructed or constructed into a garment, which is thereafter treated only on one side, e.g., on the inside surface of the fabric. As used herein, the "inside" surface of a garment refers to the surface of the fabric that is generally worn next to the skin, and the "outside" surface of a garment refers to the surface that is farthest from the skin. It is also possible that the fabric can be incorporated into a garment (or other fabric-containing products, such as linens, bedclothes, bandages, etc.) in the form of a partial or total "lining", while other portions of the garment are made of alternative fabrics. As used herein, "fabric" intends and includes a material comprising natural and/or synthetic fibers or materials, such as a network of natural and/or synthetic fibers, or a continuous porous film of natural and/or synthetic materials (e.g., porous to liquid water). The fabric is generally constructed from fibers, such as by knitting or weaving yarns spun from fibers, or by nonwoven techniques commonly known in the industry. In addition to fiber-based fabrics, the fabric could also be a porous material such as a solid open-cell foam, sponge, or film, used individually or in conjunction with other fabric layers, such as in laminated constructs. The porosity need be enough such that if the surface is hydrophilic, liquid water can wick through the material.

The fabric may be made of synthetic fibers or materials (e.g., a synthetic fabric) or natural fibers or materials (e.g., a natural fabric), or may be a blend or other combination of both synthetic fibers or materials and natural fibers or materials (such as a fabric comprising both nylon and cotton). For example, the fabric may include, but is not limited to, any of the following synthetic materials or fibers commonly used in fabric manufacturing: acrylic, nylon, polyester, olefins, and spandex. Natural fabrics include, but are not limited to, fabrics made from naturally-occurring cellulosic fibers such as cotton, jute, flax, and sisal. This also includes processed cellulosics such as rayon, acetate, and lyocell. In addition to cellulosics, other natural materials include, for example, proteinaceous materials such as leather, silk and wool.

The net hydrophobic composition is generally applied to a single surface of the fabric to form the hydrophilicity gradient that will push water from the treated surface of the fabric to the opposing, untreated surface of the fabric (e.g., from the treated, inside surface of a garment to the untreated, outside of a garment). It is recognized that the net hydrophobic composition may be applied to either surface of the fabric (inside or outside) to inhibit the retention of moisture on the treated surface of the fabric. For example, treating the outside of the garment would be useful for reducing or eliminating visible perspiration stains.

The treatment procedures assume that the untreated or outer surface of the fabric is hydrophilic, i.e. that it readily absorbs and wicks water. This is the case for most cellulosic fabrics. However, some synthetic fabrics are naturally hydrophobic and must first be treated with a hydrophilic finish to render their surface hydrophilic. Such treatments for synthetics are common and well known in the textile finishing industry and may result in a fully-hydrophilic fabric on both sides and throughout the thickness of the fabric. Exemplary synthetic fabrics and treatments include fabrics made from Invista's COOLMAX® fibers and Milliken's VISASport®, plus hydrophilic finishes provided by Nano-Tex, Lanxess, Apollo, BASF and the like. Thus, a hydrophilic fabric (whether based on synthetic or natural fibers) is a common starting point for the methods and compositions described herein. As such, the methods and compositions may be used for both naturally hydrophilic fabrics or for fabrics rendered hydrophilic.

Since moisture transfer capability of fabrics treated by the methods and/or with the compositions detailed herein is believed to be due to a hydrophilicity gradient from the treated surface of a fabric extending toward the opposing, untreated surface of the fabric, treating the fabric with the net hydrophobic composition throughout the entire thickness of the fabric (such as by immersing the entire fabric into a net hydrophobic composition or emulsion) would not be useful in the practice of the present invention as it would not create a hydrophilicity gradient.

Upon treating a single surface of a fabric with a net hydrophobic composition, the individual fabric fibers at the site of treatment become coated with the composition. The coating of fibers is heavier at the treatment surface (the site of application) and gradually diminishes into the thickness of the fabric, creating the hydrophobic gradient. Preferably, the opposing, untreated side of the fabric contains little or no fibers coated with the net hydrophobic composition.

As applied to one side of a fabric, the net hydrophobic composition durably modifies the surface properties of the treated fibers. The net-hydrophobic character required is such that a treated fiber has sufficient hydrophilicity that allows a limited amount of wetting. This limited wetting, combined with the capillary drawing forces of the hydrophilic untreated side of the fabric, drives wicking in the small capillaries and interstices between fibers and yarns in a fabric. This wicking would normally be restricted or eliminated by a completely hydrophobic coating. Once wicked to the untreated (hydrophilic) side, the moisture will not wick back to the treated side since there are very limited capillary drawing forces in the treated side. In other words, there is no driving force to move the moisture back from the hydrophilic areas to the hydrophobic areas.

The Net Hydrophobic Compositions

Net hydrophobic compositions for use in the methods and fabrics herein include without limitation net hydrophobic copolymers, net hydrophobic polymer blends (such as a blend of polymers or a blend of copolymers or a blend of a mixture of polymers and copolymers in any ratio) and net hydrophobic blends of non-polymeric reactive molecules. A net hydrophobic composition is more hydrophobic than hydrophilic but has both hydrophobic and hydrophilic components. A net hydrophobic composition applied to a single surface of a fabric forms an effectively water-repellent surface on the treated side, but is not so repellent that moisture cannot wick through the treated surface of the fabric to the opposing, untreated surface of the fabric.

One method of quantifying the hydrophobicity of the composition is by measuring the water contact angle, such as by the sessile drop technique. In this technique, a dry solid film of the composition is cast on a flat substrate. A drop of water is carefully placed on the surface, and the angle the drop makes at the interface is measured. A very hydrophobic surface will cause the water drop to bead, and will have a high contact angle. A more hydrophilic surface will wet out, and have a low contact angle. In one variation, the net hydrophobic composition has a water drop contact angle of greater than about 50° but less than about 130°. In one variation, the net hydrophobic composition has a water drop contact angle of greater than about 80° but less than about 100°. In one variation, the net hydrophobic composition has a water drop contact angle of greater than about 90° but less than about 110°. In one variation, the net hydrophobic composition has a water drop contact angle of greater than about 100° but less than about 130°. In one variation, the net hydrophobic composition has a water drop contact angle of greater than about 50° but less than about 100°. In one variation, the net hydrophobic composition has a water drop contact angle of greater than about 130°. In one variation, the net hydrophobic composition has a water drop contact angle of greater than about 120° but less than about 150°. In one variation, the net hydrophobic composition has a water drop contact angle of greater than about 130° but less than about 150°. In one variation, the net hydrophobic composition has a water drop contact angle of greater than about 50° but less than about 95°. In one variation, the net hydrophobic composition has a water drop contact angle of greater than about 50° but less than about 85°. In one variation, the net hydrophobic composition has a water drop contact angle of greater than about 100° but less than about 150°. In general, the net hydrophobic composition may have a water drop contact angle of any value greater than 50°, as long as it creates a gradient of diminishing contact angle (thus increasing hydrophilicity) from the treated surface of the fabric into the thickness of the fabric toward the opposing, untreated side of the fabric.

The copolymers useful for this invention should consist of at least two distinct monomers, one being hydrophobic, the other hydrophilic. Other monomers may be included that act in a variety of ways to improve the overall performance of the polymer molecule, such as adding reactive functionality to bond to the fabric, or to include monomers that enhance film-formation of the polymer to enhance uniform coating of the fibers (compatibilizers). The monomers useful in this invention must be capable of copolymerization (with each other), and the reaction must not change the relative hydrophobic or hydrophilic character of the monomer. One useful set of monomers is the class of free-radical polymerizable monomers. There is a wealth of such monomers that will readily copolymerize, whose hydrophobicity is defined by the side chains. Examples of hydrophobic monomers useful in this capacity include: alkyl acrylates and fluoroalkyl acrylates, vinyl esters (like vinyl acetate and vinyl stearate), halogenated vinyls (like vinyl chloride and vinylidene fluoride), styrene and styrenic derivatives, and dienes (like butadiene and isoprene). Examples of hydrophilic monomers that will copolymerize by free-radical polymerization include: acrylic acid, ethoxylated acrylates, vinyl alcohol, acrylamides and derivatives thereof, and vinyl pyrrolidone. Also included in the hydrophilic monomers category are ionic monomers such as salts of sulfonic acids (like styrene sulfonate). These are only limited practical examples, as there are many monomers that meet this basic description, including polymers that are not formed by free-radical polymerization (such as polyurethanes, silicones, and epoxies). Table 1 below lists exemplary starting materials and ratios thereof from which a net hydrophobic copolymer may be made. One of skill in the art will recognize the appropriate ratio of hydrophobic to hydrophilic monomers in order to achieve a copolymer that is net hydrophobic.

TABLE 1

Exemplary copolymer monomers

| Exemplary hydrophilic component | Exemplary hydrophobic component |
|---|---|
| Acrylic acid, ethoxylated acrylates, HEMA, vinyl alcohol, acrylamides, vinyl pyrrolidone, ethoxylated diols, sulfonic acid functionalized monomers (like styrene sulfonate). | Alkyl acrylates (like vinyl stearate and EHMA), fluoroacrylates, GMA (glycidyl methacrylate), vinyl acetate, vinyl chloride, vinylidene fluoride, styrenics, dienes, fluoroalkyl ureas, siloxanes, dicarboxylic acids (like adipic or terephthalic acid in ester formation) |

The ratio of hydrophilic component to hydrophobic component, such as those listed in Table 1, can be about 1:1,000 hydrophilic:hydrophobic, or about 1:800 hydrophilic:hydrophobic, or about 1:600 hydrophilic:hydrophobic, or about 1:400 hydrophilic:hydrophobic, or about 1:250 hydrophilic:

hydrophobic, or about 1:200 hydrophilic:hydrophobic, or about 1:150 hydrophilic:hydrophobic, or about 1:100 hydrophilic:hydrophobic, or about 1:75 hydrophilic:hydrophobic, or about 1:50 hydrophilic:hydrophobic, or about 1:25 hydrophilic:hydrophobic, or about 1:10 hydrophilic:hydrophobic, or about 1: greater than 1 but less than 10, or about 1: greater than 1 but less than 5, such as 1:4.

Exemplary commercially available net hydrophobic copolymers that have a hydrophilic component and that may be used in the methods and on the fabrics described herein include without limitation, Nano-Tex® 603B and 604B, Nuva SRC® by Clariant, TG-992 and 991 by Daikin, Mitsubishi's SR-1100, Ciba's Oleophobol ZSR®, and the like. These copolymers all contain fluoroalkyl acrylate segments (which impart the hydrophobic character) copolymerized with ethoxylated acrylate segments (which impart the hydrophilic character). In addition, similar hydrophobic/hydrophilic copolymers such as 3M's soil release product Scotchgard® (which contains fluorourea hydrophobic segments with ethylene glycol urethane hydrophilic segments), as well as polyether-ester copolymers may be used.

The copolymer of this invention may be either a random copolymer, a block copolymer, or a segmented copolymer. The monomer distribution along the polymer chain will affect its hydrophobicity, depending on the particular monomers involved. There are a range of acceptable monomer ratios and distributions that will result in a net-hydrophobic copolymer with sufficient hydrophilic character, as required by this invention.

Polymers blends that are useful for this invention comprise a hydrophobic polymer, such as one of a broad range of hydrophobic polymers generally known as being water repellent, but also known as useful in textile finishing. This includes silicones, alkyl acrylates, fluoroalkyl acrylates, waxes, and polyurethanes (among many others). Similarly, polymer blends also comprise a hydrophilic polymer, such as one of a broad range of polymers generally known as being hydrophilic, but also known as useful in textile finishing, including polymers made from vinyl alcohols, acrylic acid, ethylene oxides, vinyl pyrrolidone, acrylamide, as well as ionic polymers based on carboxylic or sulfonic acids. In addition, there are hydrophilically-modified silicones and polyurethanes. A polymer blend may also comprise a copolymer, such as any one or more of the net hydrophobic copolymers described herein, which may be blended with a hydrophilic polymer. A polymer blend may comprise a polymer and/or copolymer that contains or is modified to contain some functionality that allows or enhances the ability of the polymer and/or copolymer to bond to the surface of the fabric, such as by chemical or physical bonding. Likewise, a polymer blend may comprise a polymer and/or copolymer that contains or is modified to contain some functionality that allows or enhances the ability of the polymer and/or copolymer to bond to another polymer and/or copolymer, such as by chemical or physical bonding so as to form a polymer network. Table 2 lists exemplary starting materials and ratios thereof from which a net hydrophobic polymer blend may be made. One of skill in the art will recognize the appropriate ratio of hydrophobic to hydrophilic polymers and/or copolymers in order to achieve a polymer blend that is net hydrophobic.

TABLE 2

| Exemplary polymers and/or copolymers | |
|---|---|
| Exemplary hydrophilic component | Exemplary hydrophobic component |
| Polyethylene oxide, polyvinyl alcohol, polyacrylamide, poly acrylic acid, poly vinyl pyrrolidone, hydrophilic silicones, hydrophilic polyurethanes | Silicones, polyfluoroalkylacrylates, polyacrylates, polyurethanes, waxes |

The ratio of hydrophilic component to hydrophobic component, such as those listed in Table 2, can be about 1:1,000 hydrophilic:hydrophobic, or about 1:800 hydrophilic:hydrophobic, or about 1:600 hydrophilic:hydrophobic, or about 1:400 hydrophilic:hydrophobic, or about 1:250 hydrophilic:hydrophobic, or about 1:200 hydrophilic:hydrophobic, or about 1:150 hydrophilic:hydrophobic, or about 1:100 hydrophilic:hydrophobic, or about 1:75 hydrophilic:hydrophobic, or about 1:50 hydrophilic:hydrophobic, or about 1:25 hydrophilic:hydrophobic, or about 1:10 hydrophilic:hydrophobic, or about 1: greater than 1 but less than 10, or about 1: greater than 1 but less than 5, such as 1:4.

Exemplary hydrophobic polymers and/or copolymers for use in a net hydrophobic polymer blend that may be used in the methods and on the fabrics described herein include without limitation, fluoroacrylates from: Nano-Tex X-series, Ciba Oleophobol® series, Clariant Nuva® series, Repellan® from Cognis, Daikin TG series, Repearl® series from Mitsubishi, BASF Lurotex®, Noveon's Freepels®, Lanxess Baygard®, Rudolf Chemie RucoGuard®, Peach State Labs Sartech®, Apollo Chemical Barpel®, Omnova X-Cape®, and Eastern Chemical's RainOff®, among others. Other substances for use herein include silicones from Dow Corning, Wacker, GE Silicones, and others, and waxes from Ciba, Cognis, Noveon, Rudolf Chemie, and others as well as acrylates such as the emulsions from Rohm and Haas. There are additionally a wide variety of other readily available water-repellent textile finishing chemicals, as well as the class of hydrophobic softeners which include waxes, silicones, and olefins, among others.

Exemplary (commercially available) hydrophilic polymers and/or copolymers for use in a net hydrophobic polymer blend that may be used in the methods and on the fabrics described herein include without limitation, hydrophilic polymers commonly used in textile finishing, such as silicone softeners (such as those from Boehme Filatex, Dow Corning, GE Silicones, Cognis), hydrophilic polyurethanes (such as some of the Baypret® products from Lanxess), fatty alcohols (such as the Setilon® products from Cognis), and Clariant's Milease® series.

Net hydrophobic blends of reactive non-polymeric molecules that are useful for this invention comprise at least one hydrophobic reactive non-polymeric molecule and at least one hydrophilic reactive non-polymeric molecule. These molecules can be grafted to the surface of the fabric such that they act to modify the surface energy of the fabric, giving it a net hydrophobic character in a gradient fashion, as described above. As used herein, the term "reactive non-polymeric molecules" refers to molecules with at least one reactive group such as a hydroxyl, carboxylate, isocyanate, melamine, vinyl, or epoxide, as well as silanes, zirconates, and titanates. The molecule will generally have a reactive group on one end that will react with and/or bond to the fabric, and a hydrophobic or hydrophilic tail that remains exposed and acts to modify the surface character of the fabric. Such a surface modification technique is commonly called grafting. This technique can be used on both natural fibers as well as synthetic fibers. The blend of reactive non-polymeric molecules may comprise at least one non-polymeric molecule that contains or is modified to contain some functionality that allows or enhances the ability of the molecule to bond to the surface of the fabric, such as by chemical or physical bonding. In one variation, all of the non-polymeric molecules of the blend comprise a functionality that allows or enhances the ability of the molecule to bond to the surface of a fabric. Examples include silanes such as N-[(3-trimethoxysilyl)propyl]ethylenediamine triacetic acid, trisodium salt (a hydrophilic molecule) and alkyl trimethoxysilanes (hydrophobic molecules).

In general, the net hydrophobic compositions contain some functionality that allows at least a portion of the composition to bond to the surface of a fabric, such as by chemical or physical bonding. In this way, the fabric and the net hydrophobic composition may have complementary reactive groups. For example, a cotton fabric having free hydroxyl groups may be reacted with a net hydrophobic composition comprising a complementary reactive group, such as an N-methylol, isocyanate, or epoxide, forming chemical bonds. Similarly for polyester fabrics, there are occasional hydroxyl or carboxyl end groups capable of reacting with these same functionalities. In addition, cationic groups such as quaternary salts can be incorporated that will form strong electrostatic bonds to the normally anionic charge on cotton. In the case of polyester and nylon, groups that have strong molecular interactions in the form of hydrogen bonding or hydrophobic interactions, such as vinyl chloride, can be incorporated into the treatment composition. In one variation, the net hydrophobic composition comprises at least one of the following functional groups for bonding the composition to a surface of the fabric: hydroxyl functionality (like hydroxy ethyl methacrylate), N-methylol functionality (like N-methylol acrylamide), epoxide functionality (like glycidyl methacrylate). In one variation, the composition comprises compatiblizers, which act to enhance the interaction of the composition with the base fiber through molecular interactions, thus increasing durability of the treatment. An example of this is the use of a vinyl chloride co-monomer to enhance interactions with polyester fibers. Crosslinkers may also be used in the compositions to enhance self-crosslinking and/or bonding to fabrics, such as those commonly known in the textile finishing industry, including isocyanates, melamines, polycarboxylic acids, and urea-based resins like DMUG and DMDHEU.

It should be noted that the net hydrophobic composition, in addition to having the proper hydrophobic/hydrophilic balance, will also have the desired mechanical properties for the specific application. For example, if the application is on a fabric designed for garments, it is preferred that the net hydrophobic composition be flexible at use temperature (generally speaking for garments, this means room temperature). This is to ensure that the net hydrophobic composition treatment does not stiffen the fabric such as to adversely affect its natural drape and softness. In one variation, the glass transition ($T_g$), or softening temperature, of the net hydrophobic compositions for garment application is less than about 5-10° C. Of course, other applications may require or function better if the fabric is stiffer, such as in a technical textile used in construction materials or mechanical equipment. The flexibility of the applied treatment can be adjusted by using net hydrophobic compositions in the proper range of flexibility as required by the application, and will generally not affect the one-way moisture wicking feature of this present invention.

Formulations

In one embodiment of the invention, the net hydrophobic composition may be used without additional functionalities and/or substances beyond those required to impart a net hydrophobic character thereto and allowing the fabric to perform as described herein. However, in some instances, additional functionalities and/or substances may be desired.

For instance, a net hydrophobic copolymer composition may consist of additional co-monomers, for example, co-monomers that act to enhance performance of the treatment. Examples of such monomers that will copolymerize via free radical polymerization include vinyl chloride, epoxidized acrylates (such as glycidal methacrylate), hydroxy-functionalized acrylates (such as hydroxyethyl methacrylate), and methylol-functionalized acrylamides. These co-monomers add functionality that will either chemically react with the fabric (or other crosslinkers), or increase affinity to enhance durability of the treatment. In addition, net hydrophobic polymer blends may comprise additional polymers and/or copolymers and/or additional reactive functionalities on an existing polymer and/or copolymer. The additional components can be blended into the formulation and may act to either physically or chemically enhance bonding of the composition to the fabric. For instance, the composition may comprise hydrophilic/hydrophobic polymers and/or copolymers with additional reactive functionalities such as isocyanates, urethanes, melamines, and related resins generally known in the textile industry as binders, crosslinkers, and resins.

The net hydrophobic composition may be formulated in combination with other textile auxiliaries, known to those skilled in textile finishing. Auxiliary compounds may be added to the treatment composition, such as softeners, resins, crosslinkers, extenders, antimicrobials, etc., which are generally known in the textile industry. However, such optional ingredients should not interfere with the ability of the treatment composition to maintain the hydrophilicity gradient necessary for proper functioning. In addition, the auxiliary compounds must be compatible with the formulation chemistry as well as the application technique.

Application Methods

Ideally the formulation comprising a net hydrophobic composition should be readily applicable to a fabric, such as by standard textile finishing techniques. Such ease of use significantly increases the usefulness of the invention. For most textile finishing techniques, the applied chemistry should be readily dispersible in water. As the compositions useful in this invention are net-hydrophobic, they will generally not be water soluble. But they should be readily dispersible via standard emulsion or dispersion techniques to form stable dispersions. Such dispersions are generally stabilized by incorporating surfactants, known to those skilled in the art. This aqueous-based dispersion can be combined with any desired compatible auxiliaries as listed above to form the treatment formulation.

The stabilized dispersions can now readily be applied by any method that delivers controllable continuous coverage onto a fabric surface. These methods include spray application, foaming, knife-coating, kiss-rolling, screen printing, gravure printing, and ink jet printing. These application methods may require additional chemistry be added to the formulation to enhance applicability, such as a foaming agent is necessary for foaming application, and a thickener is generally necessary for screen printing. Whatever method of application is used, the application must be controlled such that the applied chemistry uniformly covers one side of the fabric without soaking through to the other side of the fabric. The applied chemistry should penetrate the fabric thickness from about 25 to 75% of the fabric thickness. Typically, this requires a wet pick-up of 10-50%, depending on the concentration of the treatment solution, the type of fabric, and the application technique. More details for each specific application technique are outlined in the Examples. Once applied, the fabric is then dried and cured using standard textile ovens. The cure conditions depend on the exact type of chemistry and fabric, but generally require heating the fabric to at least 100° C. and not greater than 190° C., for at least 30 seconds. It is understood by those skilled in the art that the cure conditions will vary, depending on the type of reactive chemistry involved and the temperature exposure limitations of the fabric types.

Coating Characteristics

The net hydrophobic composition coating is ideally applied by standard textile-coating applications, as previously described herein. This chemistry used in the coating is often combined with standard textile auxiliaries such as softeners, crosslinking agents, resin, and the like used in textile finishing. Thus the chemistry of this invention must be compatible with these standard textile finishing auxiliaries that would normally be used for the particular fabric. These chemistries are generally aqueous-based, such as emulsions, whose particles are small enough (<1 micron) to readily penetrate and wet individual fibers within a fabric.

Regardless of application technique, the resulting treatment, or coating, for this invention is a thin layer of formulation that coats individual fibers, predominantly on the treated side of the fabric. This coating is applied in a gradient fashion, tapering off through the thickness of the fabric. This is accomplished by controllably applying the treatment to one side, allowing it to penetrate only a fixed depth into the fabric. This depth of penetration ranges from about 25-75% of the thickness of the fabric, depending on the fabric type, construction, and extent of desired effect. An exemplary method of determining depth of penetration of a net hydrophobic composition involves dyeing a sample of treated fabric, using an aqueous-based textile dye, and then inspecting a cross section of the dyed sample, e.g., under a microscope. The dye will adhere much more strongly to untreated sections of the fibers, thus will only be visible in untreated sections of the fabric, which may provide an approximation of the depth of penetration and gradient of treatment. The resulting treated side of the fabric has a thin (<500 nm) flexible polymer finish that has little effect on the feel or hand of the fabric. Fabrics treated according to this invention are therefore breathable, soft, and natural feeling, making for a more comfortable garment. More significantly is that even when wet, they feel relatively dry against the skin.

The performance feature of moving moisture from one side to the other may be characterized primarily by two tests—(1) Absorbency Test (by prop Height) and (2) Blotting Test. The treated fabric preferably meets both performance criteria.

The Absorbency Test (prop Height) ensures that the treated fabric will absorb and transfer moisture, rather than just repel moisture. This is a measure of the hydrophilic component of the net-hydrophobic treatment. It consists of simply placing drops of water from various heights onto the treated surface of the fabric, and measuring the minimum height for the moisture to be quickly and fully absorbed into the fabric within a few (e.g. about 3 or less) seconds. To be considered effectively absorbent, a fabric should have a maximum drop height of about 4 cm (and lower is better).

Once wetted, the treated fabric should be capable of moving and retaining moisture from the treated surface of the fabric to the opposing, untreated surface. The ability of a treated fabric to transfer moisture may be quantified with the Blotting Test. This test measures the "dryness" of the treated side once moisture has been applied. It simulates water being absorbed and wicked through in one direction, leaving the inside surface dry. This is done by measuring the amount of water necessary to wet back through a test fabric to a piece of blotting fabric placed on the inside (treated) side. In this test, a small square of blotter fabric is placed on the treated side of a test sample of fabric, then a 300g weight is placed on the bottom of a 20 ml glass vial (with no cap) with the mouth side of the vial down on the blotter fabric. This applies a force of about 300 g/cm$^2$ on the blotter square since the area of the lip of the vial is about 1 cm$^2$. Then drops of water are introduced immediately next to the blotting square, which wick through the fabric and under the blotting square. As long as the treated surface remains dry, the blotting square will remain dry. The number of drops required to wet back through the fabric, with an applied load of 300 g/cm$^2$, to wet the blotting square, is the score. For effective dryness, the score should be >25-30 drops.

Additionally, coefficient of friction (CoF) measurements are also useful to characterize the improvement of the treated vs. untreated fabrics, particularly when wet. A wet fabric will have a much higher CoF than a dry fabric. The treatment described herein acts to reduce this friction by moving the moisture away from the inside surface. This is measured by a modified ASTM D1894 technique, better suited to simulate friction of fabric against the skin. A test fabric sample is pulled across a flat surface under a light applied load, measuring the force necessary to pull the fabric. We first measure the CoF of a test sample dry, then wet the fabric with a fixed volume of water to measure the wet CoF. The water is applied to the treated side (skin side) of the fabric, allowed to absorb, then the sample is turned over and placed inside-down. A light weight is placed on the fabric to hold it flat, then it is pulled at a fixed rate while measuring the pulling force with a load cell. Once wet, the treated fabric will have a lower coefficient of friction compared to an untreated version, indicating that the treated fabric will have reduced chafing.

EXAMPLES

The below examples outline several application techniques, several fabric types, and several formulation types that demonstrate the range of approaches useful for this technology. In all cases, the performance of the resulting treated fabric is characterized by two basic tests, the Absorbency (prop Height) and the Blotting Test, described above. Typical results from the below examples are tabulated in Table 3. The performance results (prop Height and Blotting Test drops) are shown at 0 and 20 home laundries (HL) as an indication of the relative durability of the treatment.

TABLE 3

Exemplary performance of various formulations and application techniques on cotton, polyester, and wool knit fabrics.

| | | | | Drop Height (cm) | | Blotting Test (drops) | |
|---|---|---|---|---|---|---|---|
| Formulation | Application | Knit Fabric | % wpu | 0 HL | 20 HL | 0 HL | 20 HL |
| Example 1 | Spray-on | 175 g/m$^2$ | 30 | 3 | 1 | >50 | 25 |

TABLE 3-continued

Exemplary performance of various formulations and application techniques on cotton, polyester, and wool knit fabrics.

| Formulation | Application | Knit Fabric | % wpu | Drop Height (cm) 0 HL | Drop Height (cm) 20 HL | Blotting Test (drops) 0 HL | Blotting Test (drops) 20 HL |
|---|---|---|---|---|---|---|---|
| | | cotton | | | | | |
| Example 2 | Silk screen printing | 175 g/m$^2$ cotton | 42 | 4 | 2 | >50 | 28 |
| Example 3 | Rotary screen printing | 175 g/m$^2$ cotton | 40 | 4 | 2 | >50 | 35 |
| Example 4 | Silk screen printing | 130 g/m$^2$ polyester | 25 | 3 | 3 | 38 | 20 |
| Example 5 | Foam | 175 g/m$^2$ cotton | 15 | 3 | 1 | 35 | 15 |
| Example 6 | Foam | 130 g/m$^2$ polyester | 15 | 3 | 3 | 25 | 10 |
| Example 7 | Silk screen printing | 180 g/m$^2$ washable wool | 36 | 5 | 3 | >50 | 25 |
| Example 8 | Silk screen printing | 175 g/m$^2$ cotton | 38 | 4 | 1 | >50 | 20 |

Example 1

Spray Coating of Hydrophilic/Hydrophobic Chemistry onto Cotton Fabric

A copolymer having both hydrophobic and hydrophilic monomers was applied by spraying the chemistry to one side of the fabric. In this example, Nano-Tex 603B fluoroacrylate copolymer emulsion was used. This copolymer contains both hydrophilic (ethoxylated acrylate) and hydrophobic (fluoroalkyl acrylate) segments, as well as additional functionality for bonding to cotton (N-methylol acrylamide). It was diluted with water to achieve concentration of about 8% to allow optimal sprayability. This solution was sprayed onto the inside surface of a 100% cotton knit fabric (175 g/m$^2$) using an aerosol sprayer. Spraying was done by hand such as to uniformly apply a continuous coating. The wet pickup was controlled to 20-35% to prevent the applied composition from soaking entirely through the cotton (such that only one side is treated). The samples were then dried and cured at 170° C. for 3 minutes. The resulting polymer add-on was about 0.8% by weight, concentrated on one side of the fabric.

The resulting treated cotton fabric looks and feels like the untreated natural cotton fabric. The outside remains untreated, and wets just like untreated cotton. The inside (treated side) quickly transfers moisture from the treated side to the untreated side (about 2-3 seconds for a water drop to pass through). The treated side remains dry to the touch. It is durable, retaining this performance after at least 20 home launderings.

Example 2

Silk Screen Printing of Combined Hydrophilic/Hydrophobic Chemistry onto Cotton Fabric The copolymer emulsion from Example 1 can also applied to one side of a fabric by known screen printing techniques, such as "silk-screening." Fine screen meshes typical of the print industry, ranging from 40-165 mesh, can be used. The printing is done as "blotch printing," meaning that no pattern is applied to the screen—the printing is done through the screen mesh alone to ensure a continuous coating. Proper wetting of the fabric is obtained by the optimal combination of print paste viscosity, screen mesh size, and application conditions. In this example, the same aqueous emulsion in Example 1 (8% Nano-Tex 603B) was thickened with a polyacrylic acid thickener (0.4% Carbopol 864 from Noveon, pH adjusted to 5.0 with KOH) until the viscosity reached about 12,000 cPs. This viscosity was determined to give optimal wetting through a 110 mesh silk screen. The thickened chemistry was screen printed onto the back side of a 100% cotton knit fabric (175 g/m$^2$) by sliding a squeegee over a 110 mesh silk screen forcing the thickened paste onto the cotton fabric. By using a silk screen with no pattern, and this viscosity, the resulting coating is essentially uniform and continuous. The wet pickup was controlled to 35-45% to prevent the applied chemistry from soaking through the cotton (such that only one side was treated). The samples were then dried and cured at 170° C. for 3 minutes. After curing, the fabric was then washed to remove the thickener.

Once washed, the fabric again looks and feels like the natural cotton fabric. The resulting treated cotton fabric quickly transfers moisture from the treated side to the untreated side (about 2-3 seconds for a water drop to pass through). Immediately after moisture transfer, the area feels dry to the touch on the treated side.

Example 3

Rotary Screen Printing of Combined Hydrophilic/Hydrophobic Chemistry onto Cotton Fabric Similar to Example 2, the copolymer can also be applied to one side of a fabric by rotary screen printing. This technique is similar to silk-screening, but can be run as a continuous production process. Also, as in Example 2, the screen contains no engraved print patterns for continuous blotch printing. Screen meshes typical of the print industry, ranging from 105-165 mesh, can be used. Again, proper wetting of the fabric is obtained by the optimal combination of print paste viscosity, screen mesh size, and application conditions. There are a variety of conditions that will work for this application. The requirement is that the paste uniformly wets out the fabric surface. One skilled in screen printing will know these parameters and how they may be adjusted. These will depend on the equipment type. Exemplary ranges of viscosity include the range of about 5000 to about 20,000 cPs as measured by a Brookfield viscometer at 20 rpm using spindle 6. In this example, the composition consisting of 6% Nano-Tex 603B and 3% Sedgeres PCR-2 from Omnova (a common crosslinking resin for cotton, added to reduce shrinkage in cotton) was thickened with a polyacrylamide-based thickener (4% Cindet FCT from Bozzetto, pH adjusted to 6.0 with citric acid) until the viscosity reached about 8,000 cPs. A small amount of a wetting agent (0.1% WetAid NRW from Noveon) was added to enhance the wetting of the small pore sizes typical of the metal screens used in rotary screen printing. This viscosity was determined to give optimal wetting through a 125-mesh metal screen. The thickened chemistry was screen printed onto a 100% cotton knit fabric (175 g/m$^2$) by running the fabric on a typical commercial scale rotary screen printer (such as a Stork or Zimmer system). The wet pickup was controlled to 25-45% to prevent the applied chemistry from soaking through the cotton (such that only one side is treated). The conditions for the system must be optimized for the specific fabric by adjusting the paste viscosity, the fabric speed, and the application pressure. The samples were then dried and cured at 170° C. for 2 minutes. After curing, the fabric was washed to remove the thickener.

Once washed, the fabric again looks and feels like the natural cotton fabric, and quickly transfers moisture from the treated side to the untreated side (about 2-3 seconds for a water drop to pass through). As before, immediately after moisture transfer, the area feels dry to the touch on the treated side.

Example 4

Screen Printing of Hydrophilic/Hydrophobic Chemistry onto Hydrophilic Polyester Fabric This treatment is not limited to cotton; it can be applied to other fabrics such as wool, silk, linen, rayon, polyester and other synthetics. Synthetic fabrics may be used as long as the fabric is either inherently hydrophilic or has been treated to become hydrophilic (such as is commonly used in active wear). In this example, a 100% polyester knit fabric, pretreated to be durably hydrophilic, was treated by a silk-screening technique similar to Example 2. The copolymer composition was adjusted to use a more polyester-durable formulation, but functions similarly to the formulation of Example 2. An aqueous emulsion of 4% Nano-Tex 603B and 2% Nano-Tex X168 (a fluoroacrylate with high affinity for polyester) were mixed. As before, the polymer blend was thickened with 5% Cindet FCT (pH adjust to 6.0) until the viscosity reached about 12,000 cPs. This was determined to give optimal wetting through the screen (the same screen as in Example 2). The thickened chemistry was screen printed onto a 100% polyester knit fabric (130 g/m$^2$) by sliding a squeegee over the screen forcing the thickened paste onto the polyester fabric. The wet pickup was controlled to 10-30% to prevent the applied chemistry from soaking through the fabric (such that only one side was treated). The samples were then dried and cured at 170° C. for 2 minutes. After curing, the fabric was then washed to remove the thickener.

The resulting treated polyester fabric quickly transfers moisture from the treated side to the untreated side (about 2-3 seconds for a water drop to pass through). Immediately after moisture transfer, the area feels dry to the touch on the treated side. As with cotton, this treatment is durable (retains its properties after 20 repeated launderings).

Example 5

Foam Application of Hydrophilic/Hydrophobic Chemistry onto Cotton Fabric

The copolymer emulsion from Example 1 can also applied to one side of a fabric by foaming techniques, a standard textile finishing process. The copolymer emulsion must be combined with a foaming agent, such as an ethoxylated alkyl ether, at the appropriate concentration to form a low density, stable foam. Typical foaming densities range from 10:1 to 30:1 blow ratio, which correspond to a foam density in the range of about 0.10 to about 0.033 g/cc. Since lower wet pickups are readily obtained, the chemistry is generally more concentrated. In this example, foaming agent Hostapur HAF from Clariant was used at 1% along with 12% Nano-Tex 603B. An additional water repellency copolymer, Nano-Tex 603A (a fluoroacrylate) was also included at 4% to slightly increase repellency. The foam was made using a simple KitchenAid mixer, using the wisk attachment and whipping at full speed for 5 minutes. The foam density and stability must be sufficient for uniform application. Here the foam density was 0.06 g/cc with a half-life (time for half of the foam to collapse) of 6 minutes. Ideally the foam will have a density of between about 0.10 and 0.05 g/cc. The half-life should be at least 5 minutes. The foam was then quickly applied controllably to only one side of the fabric by hand-coating with a metal blade. The height of the foam was controlled to obtain a 15% wet pick up. Penetration depth of the chemistry into the fabric was controlled by the coating speed, as well as the foam density. The samples were then dried and cured at 170° C. for 3 minutes. No washing was necessary.

The resulting treated cotton fabric quickly transfers moisture from the treated side to the untreated side (about 2-3 seconds for a water drop to pass through). Immediately after moisture transfer, the area feels dry to the touch on the treated side. Again, the treatment is durable.

Example 6

Foam Application of Hydrophilic/Hydrophobic Chemistry onto Hydrophilic Polyester Fabric Foaming can also be used on synthetic fiber fabrics, such that the thickening agent used in screen printing may be avoided. The copolymer emulsion from Example 4 without the thickener was used to make the foam, at approximately double the concentration. The foam was made as in Example 5, using 1% Hostapur HAF. The foam was applied by hand onto the inside surface of a hydrophilic polyester knit fabric (which had been previously treated to render the fabric hydrophilic), forming a continuous uniform coating. The wet pickup was controlled to 10-15% to prevent the applied composition from soaking through the polyester (such that only one side was treated). The samples were then dried and cured at 170° C. for 2 minutes.

The resulting treated polyester fabric looks and feels like the hydrophilic polyester fabric. It also quickly transfers moisture from the treated side to the untreated side (about 2-3 seconds for a water drop to pass through).

Example 7

Screen Printing of Combined Hydrophilic/Hydrophobic Chemistry onto Wool Fabric

As previously mentioned, this treatment can be applied to most any fabric, including wool. For the moisture transfer to be effective, the wool is ideally pretreated to be washable, as would be most useful for active wear. In this example, a 100% merino washable wool knit fabric (180 g/m$^2$) was treated by a silk-screening technique similar to Example 2. The composition was adjusted to use a more wool-durable formulation. 2% Nano-Tex X490, a fluoroacrylate copolymer known for its durability on wool, is combined with 4% Nano-Tex 603B. As before, the emulsion was thickened with 5% Cindet FCT (pH adjust to 6.0) until the viscosity reaches about 12,000 cPs. This was determined to give optimal wetting through the screen (the same screen as in Example 2). The thickened chemistry was screen printed onto the wool knit fabric by sliding a squeegee over the screen forcing the thickened paste onto the wool fabric. The wet pickup was controlled to 30-40% to prevent the applied chemistry from soaking through the wool (such that only one side was treated). The samples were then dried and cured at 170° C. for 2 minutes. After curing, the fabric was then washed to remove the thickener.

Once washed, the treated wool fabric again looks and feels like the original wool fabric. The resulting treated wool fabric quickly transfers moisture from the treated side to the untreated side (about 3-6 seconds for a water drop to pass through). Immediately after moisture transfer, the area feels dry to the touch on the treated side.

Example 8

Screen Printing Application of Hydrophilic/Hydrophobic Chemistry onto Cotton Fabric In all previous examples, fluoroacrylate copolymers were used. As was outlined in the description of the invention, a wide range of hydrophobic/hydrophilic polymers and copolymers may be used. In this example, a composition of a waxy water repellent combined with a hydrophilic silicone softener were applied by screen printing. 5% Phobotex JVA from Ciba (a water-repellent wax emulsion) was mixed with 2% Nano-Tex 603C (a hydrophilic silicone emulsion). The paste was thickened with 4% Cindet FCT, and pH adjusted to 6.0 with citric acid. The thickened chemistry was screen printed onto the cotton knit fabric by sliding a squeegee over a 110 mesh silk screen forcing the thickened paste onto the cotton. The wet pickup was controlled to 35-45% to prevent the applied chemistry from soaking through the cotton (such that only one side was treated). The samples were then dried and cured at 170° C. for 2 minutes. After curing, the fabric was then washed to remove the thickener.

The resulting treated cotton fabric quickly transfers moisture from the treated side to the untreated side (about 2-3 seconds for a water drop to pass through). Immediately after moisture transfer, the area feels dry to the touch on the treated side. Again, the treatment is durable.

Although the foregoing invention has been described in some detail by way of illustration and example for purposes of clarity of understanding, it is apparent to those skilled in the art that certain minor changes and modifications will be practiced. Therefore, the description and examples should not be construed as limiting the scope of the invention.

All references, publications, patents, and patent applications disclosed herein are hereby incorporated herein by reference in their entirety.

We claim:

1. A method of making a hydrophilic fabric having a hydrophilic gradient within the fabric comprising treating one surface of the fabric with a net hydrophobic composition so that the treated fabric has the net hydrophobic composition applied uniformly at the one treated surface, a hydrophilic gradient within the fabric, and is configured for transferring moisture from the one treated surface of the fabric to an opposing, untreated surface of the fabric, wherein the net hydrophobic composition comprises a member selected from the group consisting of a net hydrophobic copolymer, a net hydrophobic polymer blend, and a net hydrophobic mixture of non-polymeric reactive molecules.

2. The method of claim 1 wherein the hydrophilic fabric comprises synthetic fibers or materials.

3. The method of claim 1 wherein the hydrophilic fabric comprises natural fibers or materials.

4. The method of claim 1 wherein the net hydrophobic composition further comprises one or more textile auxiliary compounds.

5. The method of claim 1 wherein the net hydrophobic composition comprises a net hydrophobic copolymer.

6. The method of claim 5 wherein the copolymer is a fluoroacrylate copolymer comprising ethoxylated acrylate and fluoroalkyl acrylate components.

7. A method of modifying the moisture transfer ability of a fabric by making a hydrophilic fabric having a hydrophilic gradient within the fabric comprising treating, a single surface of the fabric with a net hydrophobic composition comprising a member selected from the group consisting of a net hydrophobic copolymer, a net hydrophobic polymer blend, and a net hydrophobic mixture of non-polymeric reactive molecules, wherein the treated fabric has a uniform coating comprising the net hydrophobic composition at the treated single surface of the fabric;

wherein the treated fabric has a hydrophilic gradient within the fabric; and wherein the treated fabric is configured for wicking moisture from the treated single surface side of the fabric to an opposing untreated side of the fabric.

8. The method of claim 7 wherein the hydrophilic fabric comprises synthetic fibers or materials.

9. The method of claim 7 wherein the hydrophilic fabric comprises natural fibers or materials.

10. The method of claim 7 wherein the net hydrophobic composition further comprises one or more textile auxiliary compounds.

11. The method of claim 7 wherein the net hydrophobic composition comprises a net hydrophobic copolymer.

12. The method of claim 11 wherein the copolymer is a fluoroacrylate copolymer comprising ethoxylated acrylate and fluoroalkyl acrylate components.

13. A hydrophilic fabric having a hydrophilic gradient within the fabric wherein the hydrophilic fabric is configured for transferring moisture from a treated surface of the hydrophilic fabric to an opposing, untreated surface of the fabric, wherein the fabric contains a net hydrophobic composition uniformly applied to the treated surface of the fabric and wherein the net hydrophobic composition comprises a member selected from the group consisting of a net hydrophobic copolymer, a net hydrophobic polymer blend, and a net hydrophobic mixture of non-polymeric reactive molecules.

14. The hydrophilic fabric of claim 13 wherein the fabric comprises synthetic fibers or materials.

15. The hydrophilic fabric of claim 13 wherein the fabric comprises natural fibers or materials.

16. The hydrophilic fabric of claim 13 wherein the net hydrophobic composition further comprises one or more textile auxiliary compounds.

17. The hydrophilic fabric of claim 13 wherein the net hydrophobic composition comprises a net hydrophobic copolymer.

18. The hydrophilic fabric of claim 17 wherein the copolymer is a fluoroacrylate copolymer comprising ethoxylated acrylate and fluoroalkyl acrylate components.

* * * * *